United States Patent [19]

Kato et al.

[11] Patent Number: 4,960,337

[45] Date of Patent: Oct. 2, 1990

[54] RIBBON MASK FOR A PRINTER

[75] Inventors: Toshikiyo Kato; Yasuo Ichikawa; Wataru Ito; Hiroshi Ikeda; Yoshio Kamata, all of Tanashi, Japan

[73] Assignee: Citizen Watch Co., Ltd., Tokyo, Japan

[21] Appl. No.: 308,796

[22] Filed: Feb. 10, 1989

[30] Foreign Application Priority Data

Feb. 13, 1988 [JP] Japan ..... 63-17975[U]

[51] Int. Cl.[5] ..... B41J 35/06; B41J 35/26

[52] U.S. Cl. ..... 400/248; 400/642; 400/645.1

[58] Field of Search ..... 400/248, 248.1, 247, 400/642, 645.1

[56] References Cited

U.S. PATENT DOCUMENTS

| | | | |
|---|---|---|---|
| 1,174,555 | 3/1916 | Fowler | 400/645.1 |
| 3,874,285 | 4/1975 | Kodaira et al. | 400/248 |
| 4,410,291 | 10/1983 | Speraggi | 400/247 |
| 4,452,542 | 6/1984 | Akazawa | 400/124 |
| 4,496,256 | 1/1985 | McMorrow et al. | 400/59 |
| 4,571,102 | 2/1986 | Ono et al. | 400/248 |
| 4,773,779 | 9/1988 | Wyne | 400/247 |

*Primary Examiner*—David A. Wiecking
*Assistant Examiner*—John S. Hilten
*Attorney, Agent, or Firm*—Birch, Stewart, Kolasch & Birch

[57] ABSTRACT

A dot matrix printer having a platen, a carriage, and a print head mounted on the carriage. A paper guide is secured to the carriage. A ribbon mask made of a resilient plate is attached to the paper guide. A cantilevered resilient plate is formed in the ribbon mask so as to be abutted on a front end of the print head to form a path for a ribbon between the resilient plate and the print head.

3 Claims, 5 Drawing Sheets

RIBBON MASK FOR A PRINTER

BACKGROUND OF THE INVENTION

The present invention relates to a ribbon mask for a dot matrix impact printer In the dot matrix impact printer, the ribbon mask is provided on a carriage between an inked ribbon and a printing paper for preventing the ribbon from coming into contact with the paper.

Japanese Utility Model Applications Laid-open Nos. 61-170561 and 55-45540 disclose a ribbon mask for a printer in which a lower end of the ribbon mask is secured to a member mounted on a carriage (first prior art). Japanese Utility Model Application Laid-open No. 61-138558 discloses a ribbon mask in which both lateral ends of the ribbon mask are engaged with grooves formed in ribbon guide bars vertically provided on a carriage and a lower end of the ribbon mask is engaged with an engaging portion provided on the carriage (second prior art). Japanese Utility Model Application Laid-open No. 59-46262 discloses a ribbon mask in which both ends of the ribbon mask is secured to a ribbon guide (third prior art).

If the ribbon mask is moved to the paper during the printing, the paper will be stained with ink. In order to prevent the contact of the inked ribbon with the paper, the ribbon mask must be accurately positioned with respect to the print head.

For example, if the distance (A) between tip ends of print wires of the print head and a platen is 0.40 mm, the thickness (B) of the printing paper is 0.10 mm, the thickness (C) of the inked ribbon is 0.12 mm, and the thickness (D) of the ribbon mask is 0.08 mm, accuracy for the position of the ribbon mask is $$A-(B+C+D)=0.10 \text{ mm.}$$

This is beyond the capability of a manufacturing machine.

The position of the ribbon mask of each of the prior art references described above is influenced by the following factors. In the first prior art, the accuracy of the position of the ribbon mask depends on positional accuracy at the mounting of the ribbon mask, and flatness and upright angular accuracy of the ribbon mask. In the second prior art, it depends on positional accuracy at the mounting of the ribbon guide bars, accuracy of the grooves in the guide bars and flatness of the ribbon mask. In the third prior art, it is influenced by the positional accuracy of the ribbon guide, and positional accuracy of the ribbon mask.

As described above, in the above prior art; since the position of the ribbon mask is dependent on accuracies of members for mounting the ribbon mask, the members must be manufactured and assembled to a strict precision.

SUMMARY OF THE INVENTION

The object of the present invention is to provide a ribbon mask for a dot matrix impact printer where the position of the ribbon mask alone can be accurately positioned with respect to a print head, thereby allowing for greater tolerances for working and assembling of the parts of the printer.

According to the present invention, there is provided a ribbon mask for a printer having a platen, a carriage provided to be reciprocated in parallel with the axis of the platen and a print head mounted on the carriage. A paper guide is secured to the carriage. The ribbon mask is made of a resilient plate and attached to the paper guide. A cantilevered resilient plate is defined in the ribbon mask through a slit so as to extend in the vertical direction. The resilient plate is arranged to be abutted on a front end of the print head to form a path for a ribbon between the resilient plate and the print head.

In one aspect of the invention, the, ribbon mask has a center portion, rearwardly slanted portions formed on opposite sides of the center portion, and ribbon guide portions formed outside of the slanted portions, the resilient plate being formed in the center portion and slanted portions so that the resilient plate has slanted portions on both sides thereof.

Other objects and features of the present invention will become more apparent from the following detailed description with reference to the accompanying drawings.

DETAILED DESCRIPTION OF THE INVENTION

Figure 1:
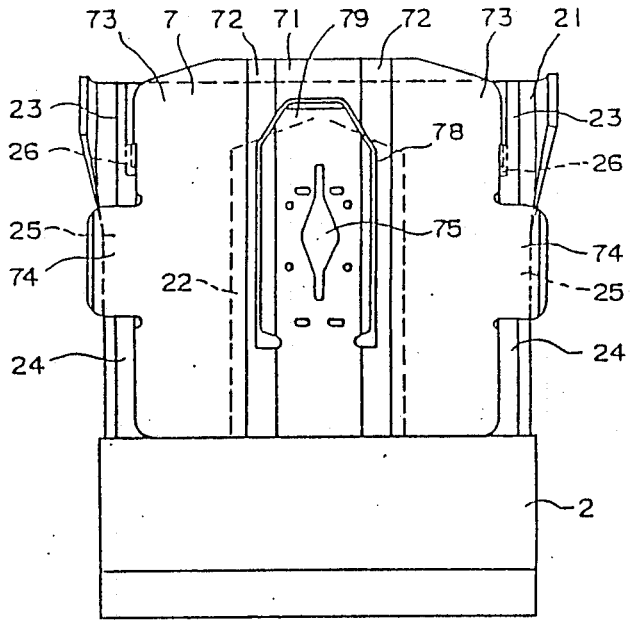
FIG. 1 is a rear view of a main part showing a ribbon mask mounted on a carriage according to the present invention.
Figure 2:
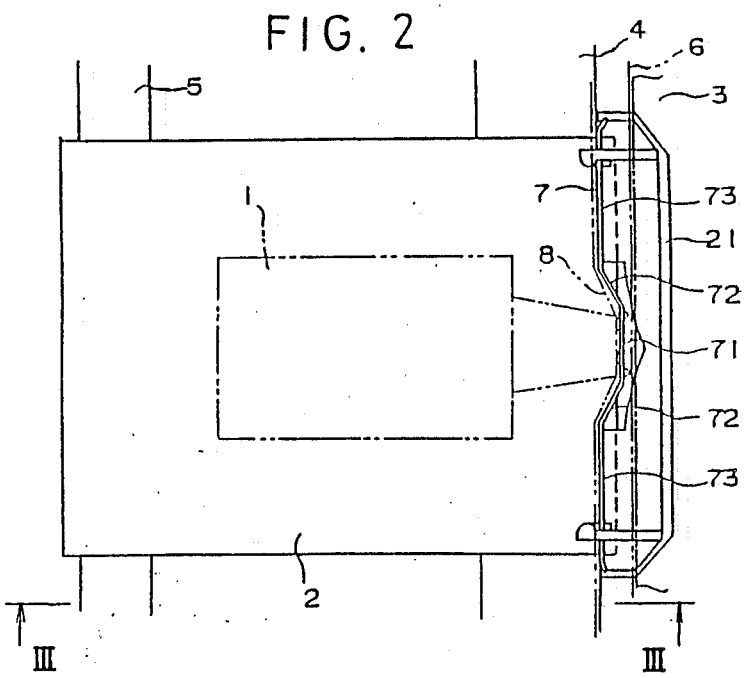
FIG. 2 is a plan view of the part of FIG. 1.
Figure 3:
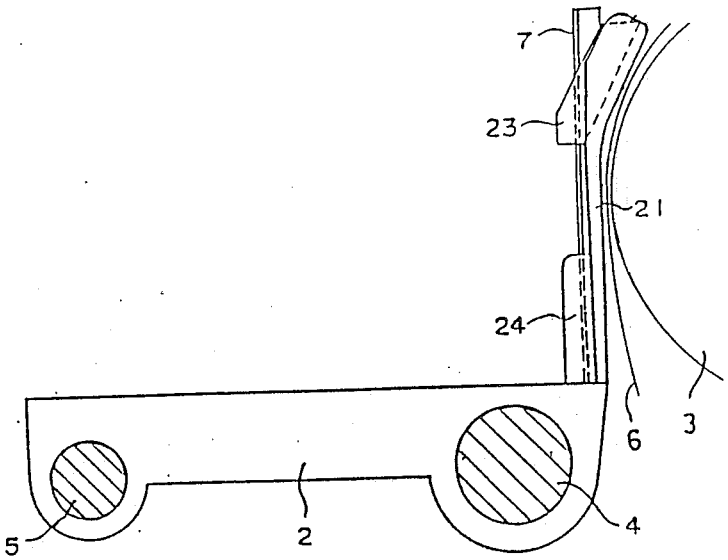
FIG. 3 is a sectional side view of the same taken along a line III—III of FIG. 2.

Referring to FIGS. 1 to 3, a carriage 2 having a print head 1 mounted thereon is slidably mounted on a pair of carriage guide bars 4 and 5 disposed in parallel with an axis of a platen 3. The carriage 2 is reciprocated along guide bars 4 and 5, for performing printing by way of the print head 1. A paper guide 21 made of plastic is secured to the carriage 2 at a front end portion of the carriage 2, for guiding a printing paper 6. As shown in FIG. 3, an upper portion of the paper guide 21 is curved along the surface of the platen 3 to guide the paper 6. The back side of the paper guide 21 is formed to attach a ribbon mask 7, as described hereinafter.

Figure 5:
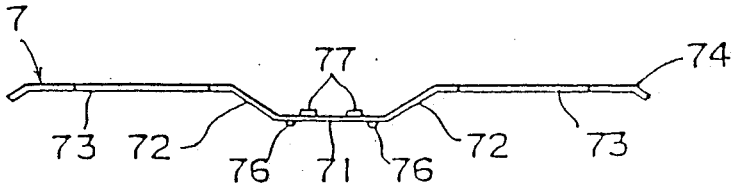
FIG. 5 is a plan view of the ribbon mask.
Figure 6:
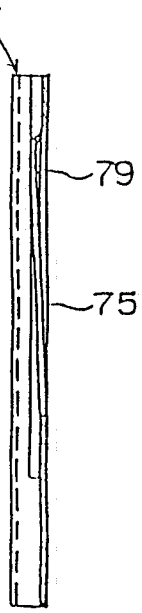
FIG. 6 is a sectional side view of the ribbon mask taken along a line VI—VI of FIG. 4.

Referring to FIGS. 5 to 6, the ribbon mask 7 is made of a resilient metal plate. The ribbon mask has a center portion 71, slant portions 72 formed on opposite sides of the center portion 71, ribbon guide portions 73 formed outside the slanted portions 72, and connecting lugs 74 projected from the ribbon guide portions 73. The slanted portion 72 is rearwardly slanted, so that the ribbon guide portion 73 is positioned behind the center portion 71 with respect to the paper guide 21. Each ribbon guide portion 73 has a shoulder **73*a* at an upper portion with respect to the connecting lugs 74. The center portion 71 has a hole 75 in a center thereof, corresponding to the front end of the print head 1. An inverted U-shaped slit 78 is formed in the center portion 71 and the slanted portions 72 surround the hole 75 so that a resilient vertical plate 79 as a cantilevered spring plate is formed in the center portions 71**. As shown in FIG. 6, the resilient plate 79 is inwardly bent. A pair of paper side projections 76 and a pair of ribbon side projections 77 are formed on the center portion 71 at upper and lower portions of the resilient plate 79, respectively. The paper side projections 76 are forwardly projected toward the paper 6 (FIG. 2) and the ribbon side projections 77 are rearwardly projected toward the print head 1.

Figure 7:
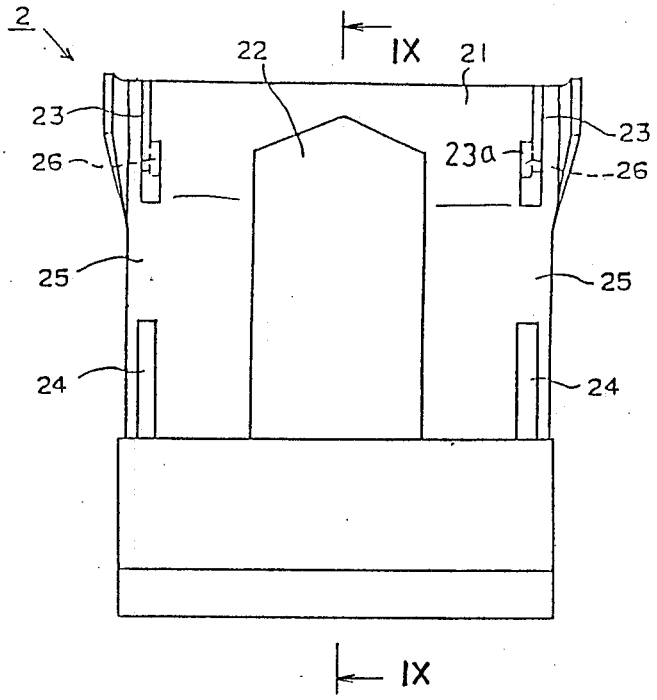
FIG. 7 is a rear view of the carriage.
Figure 8:
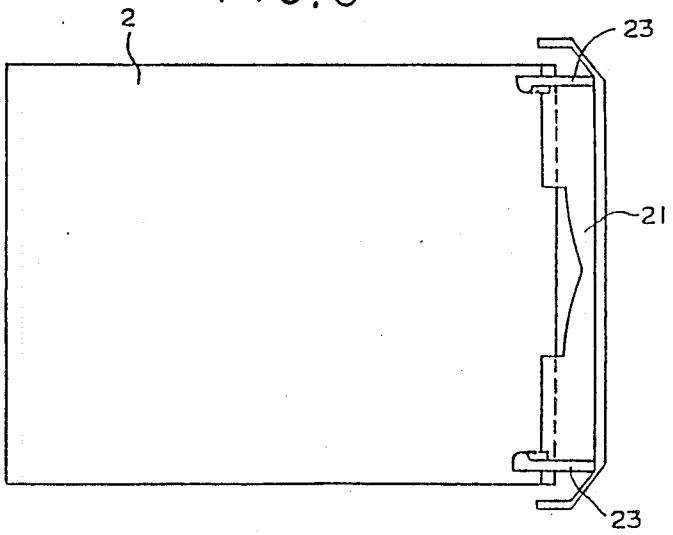
FIG. 8 is a plan view of the carriage.
Figure 9:
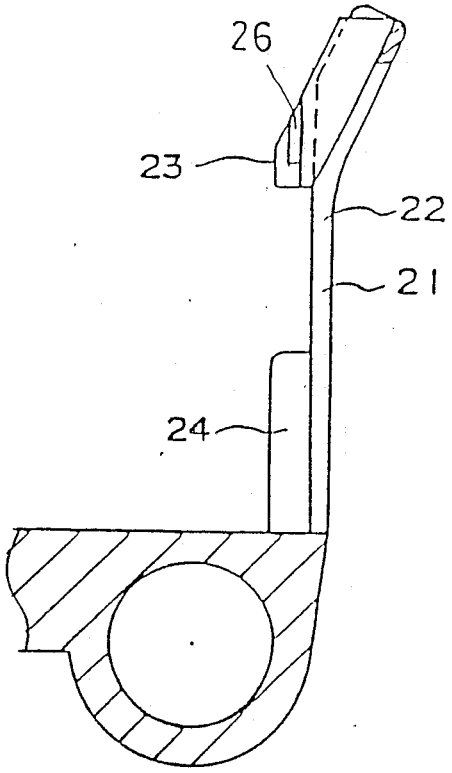
FIG. 9 is a sectional side view of the carriage taken along a line IX—IX of FIG. 7.

Referring to FIGS. 7 to 9, the paper guide 21 has a window 22 formed in a center thereof corresponding to the resilient plate 79 of the ribbon mask 7. As shown in FIG. 1, the width of the window 22 is slightly wider than the width of the center portion 71. A pair of upper positioning projections 23 are formed on the back side of the paper guide 21. Each of the positioning projections 23 has an inwardly projected portion 23*a* at a lower portion thereof and a vertical groove 26 is formed inside the projected portion 23*a* to be engaged with the shoulder 73*a* of the ribbon guide portion 73. A pair of lower positioning projections 24 are formed on lower portions of the paper guide, corresponding to the upper positioning projections 23. Positioning recesses 25 are defined by corresponding upper and lower positioning projections 23 and 24, for engaging the connecting lugs 74 of the ribbon mask 7.

When the ribbon mask 7 is attached to the paper guide 21, lugs 74 are slightly bent in the rearward direction and the ribbon mask is lowered, engaging the shoulders 73*a* of the ribbon guide portions 73 with the grooves 26. Finally, the upper and lower edges of the connecting lugs 74 are engaged with the projections 23 and 24. Thus, the ribbon mask 7 is positioned by projections 23 and 24.

Describing the function of the resilient plate 79 of the ribbon mask 7, when the ribbon mask 7 is attached to the paper guide 21 in the above described manner, the resilient plate 79 is inwardly deflected beyond the position of the front end of the print head 1. Accordingly, when the print head 1 is mounted on the carriage 2, the resilient plate 79 abuts on the front end of the print head 1 by the elastic force of the flexible plate 79.

Errors in dimensions of the ribbon mask 7 and the paper guide 21 which affect the position of the ribbon mask 7 are absorbed by the elasticity of the resilient plate 79, and projections 77 of resilient plate 79 are always abutted on the front end of the print head 1 to form a path for a ribbon 8. Thus, the resilient plate 79 is exactly positioned with respect to the front end of the print head. Since the plate 79 is deflected away from the print head 1, the inked ribbon 8 inserted between the print head 1 and the ribbon mask 7 can be easily exchanged.

The ribbon mask of the present invention is effectively used with a printer having a color printing function. The width of a color inked ribbon is twice or three times as wide as that of a standard inked ribbon. When the color printing is performed, the color inked ribbon is vertically reciprocated between the print head 1 and projections 76 provided for forming the path for the inked ribbon 8. In the present invention, since the resilient plate 79 of the ribbon mask 7 is yieldably abutted on the print head 1 by a proper elasticity, the color inked ribbon can be vertically reciprocated the proper sliding resistance.

Figure 4:
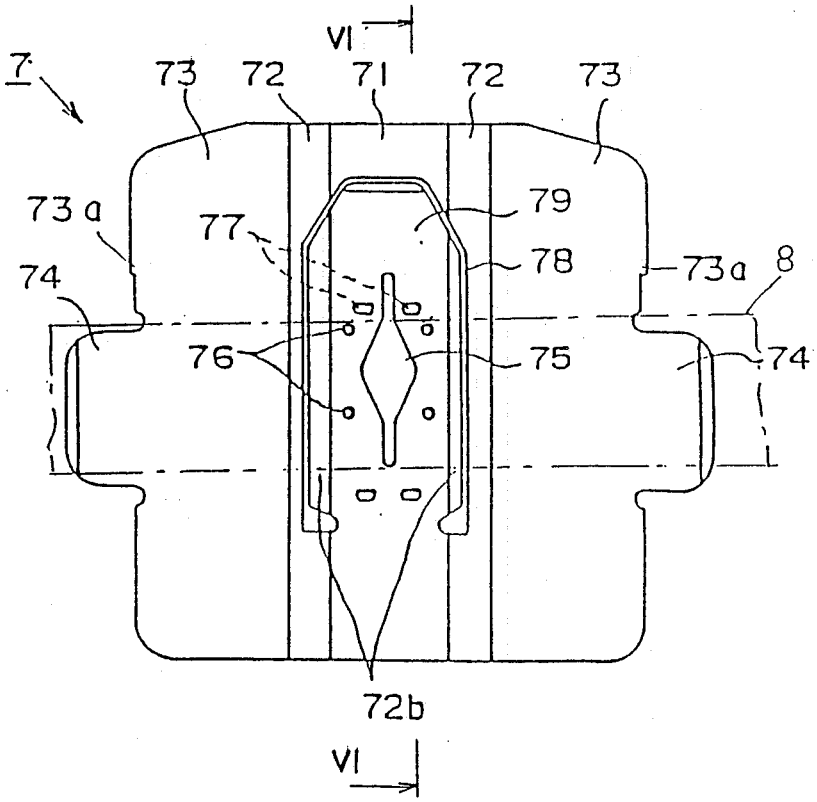
FIG. 4 is a front view of the ribbon mask.

The resilient plate 79 has a pair of slanted portions 72*b* (FIG. 4) so that the resilient plate 79 is prevented from being caught by the paper, staples on the paper or perforations formed in the paper. Further, the ribbon 8 is rearwardly deflected by guide portions 73, so that the slanted portions 72*b* are prevented from coming into contact with the ribbon 8. The reason why the guide portions 73 are provided is that if the ribbon contacts with the slanted portions 72*b*, the resilient plate 79 is deflected to the paper guide 21.

In accordance with the present invention, the ribbon mask has a resilient plate in the form of a cantilevered spring. Thus, tolerances for working and assembling parts for the ribbon mask can be eased.

While the invention has been described in conjunction with preferred specific embodiment thereof, it will be understood that this description is intended to illustrate and not limit the scope of the invention, which is defined by the following claims.

What is claimed is:

1. A ribbon mask for a printer having a platen, a carriage provided to be reciprocated in parallel with a longitudinal axis of the platen, a vertical supporting member secured to the carriage and a print head mounted on the carriage, said ribbon mask comprising a resilient plate attached to said supporting member, said resilient plate having defined therein, by an inverted U-shaped slit, a cantilevered resilient member of said resilient plate so as to extend in a vertical direction, said resilient plate being arranged so as to abut a front end of said print head to form a path for a ribbon between said resilient plate and said print head.

2. The ribbon mask according to claim 1, wherein said resilient plate includes a center portion, rearward projecting slanted portions formed on opposite sides of said center portion, and ribbon guide portions formed outside of said slanted portions, said cantilevered resilient member of said resilient plate being formed in said center portion between said slanted portions said resilient member having slanted portions on both sides thereof.

3. The ribbon mask according to claim 1, wherein said supporting member is a paper guide for guiding a printing paper.

* * * * *